US006277800B1

(12) United States Patent
Galloway

(10) Patent No.: US 6,277,800 B1
(45) Date of Patent: Aug. 21, 2001

(54) ALL PURPOSE HOUSEHOLD CLEANER COMPRISING RUBBING ALCOHOL AND AMMONIA

(76) Inventor: Iris Galloway, 125 McKibben St., Rossville, IL (US) 60963

( * ) Notice: Subject to any disclaimer, the term of this patent is extended or adjusted under 35 U.S.C. 154(b) by 0 days.

(21) Appl. No.: 09/781,606

(22) Filed: Feb. 13, 2001

(51) Int. Cl.[7] ..... C11D 3/44; C11D 3/04

(52) U.S. Cl. ..... 510/180; 510/181; 510/182; 510/235; 510/243; 510/245; 510/271; 510/432; 510/435

(58) Field of Search ..... 510/180, 181, 510/182, 235, 243, 245, 271, 432, 435

(56) References Cited

U.S. PATENT DOCUMENTS

| | | | | |
|---|---|---|---|---|
| 4,311,608 | | 1/1982 | Maurice . | |
| 4,511,488 | | 4/1985 | Matta . | |
| 4,620,937 | | 11/1986 | Dellutri . | |
| 4,952,248 | * | 8/1990 | Aberg | 134/40 |
| 4,983,317 | | 1/1991 | Requejo et al. . | |
| 5,002,684 | * | 3/1991 | Beck et al. | 252/105 |
| 5,008,030 | | 4/1991 | Cook et al. . | |
| 5,679,631 | | 10/1997 | Bohnert et al. . | |
| 5,929,004 | * | 7/1999 | Ushijima et al. | 510/100 |

* cited by examiner

*Primary Examiner*—Mark Kopec
*Assistant Examiner*—Charles Boyer
(74) *Attorney, Agent, or Firm*—William P. Smith

(57) ABSTRACT

An all purpose household cleansing solution is disclosed. An aqueous solution comprising 6 parts of water to 1 part each of liquid rubbing alcohol and liquid ammonia is combined with two tablespoons of lemon scented liquid dish detergent to form an improved, safe all-purpose cleanser which replaces numerous other household cleansers. The all purpose household cleansing solution is adaptable for application from a spray bottle or may be diluted in a gallon of water depending on the strength required of the cleaning job.

4 Claims, 2 Drawing Sheets

ALL PURPOSE HOUSEHOLD CLEANER COMPRISING RUBBING ALCOHOL AND AMMONIA

RELATED APPLICATIONS

This invention was disclosed in Disclosure Document No. 467717 filed on Jan. 18, 2000.

BACKGROUND OF INVENTION

The invention discloses an all purpose household cleanser. This cleanser is a safe all-purpose cleanser designed to replace numerous cleansers used to clean the home. The aqueous solution contains rubbing alcohol, ammonia and dishwashing detergent. This may be further diluted in water or applied full strength.

SUMMARY OF THE INVENTION

What is disclosed is an improved household cleaning solution consisting of one pint liquid rubbing alcohol, one pint liquid ammonia, three quarts of water, plus two tablespoons of liquid dishwashing detergent. The improved household cleaning solution optionally may include liquid dishwashing detergent with a lemon scent. The improved household cleansing solution comprises by volume ⅛ part liquid rubbing alcohol; ⅛ part liquid ammonia; ¾ part tap water, to which is added two tablespoons of liquid dishwashing detergent.

It is an object of the present invention to provide an all purpose household cleanser adaptable for cleaning virtually any household surface, including floors, windows. carpets. upholstery and other items.

It is further an object of the present invention to provide a safe, all-purpose cleanser which is designed to replace virtually all other cleansers used to clean the home.

It is yet another object of the present invention to provide an all purpose household cleanser that may be used full strength or further diluted as desired.

Yet another object of the present invention is to provide an all purpose household cleanser that quickly and easily cleans most surfaces in and around a home or office.

DETAILED DESCRIPTION OF THE INVENTION

Figure 1:
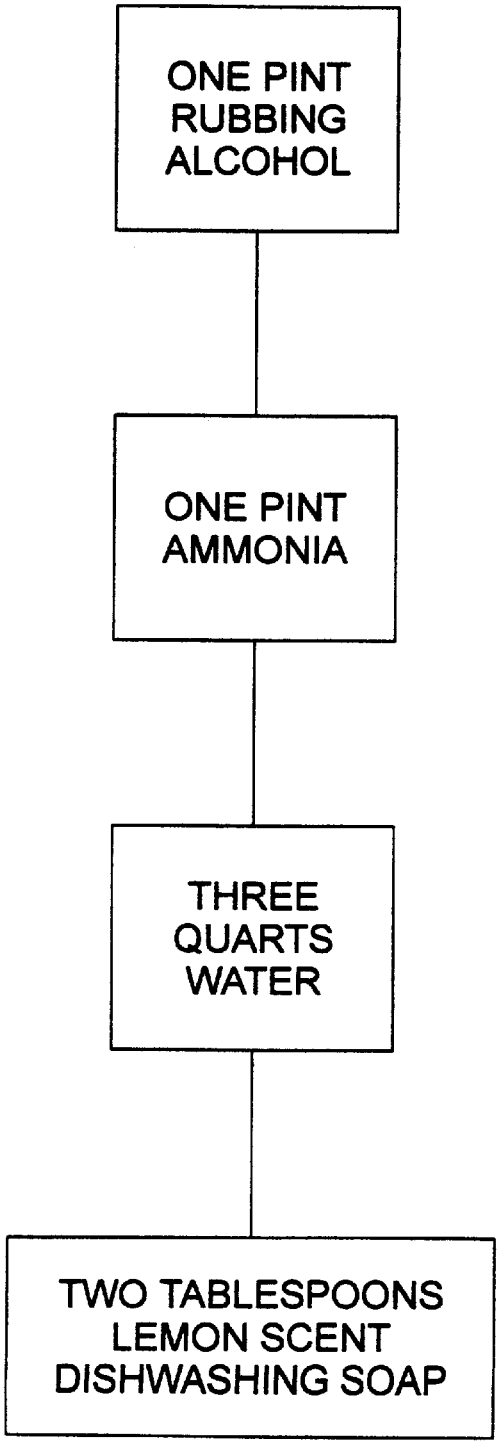
FIG. 1 illustrates a flow chart setting forth the volumes of the elements to be combined in solution.
Figure 2:
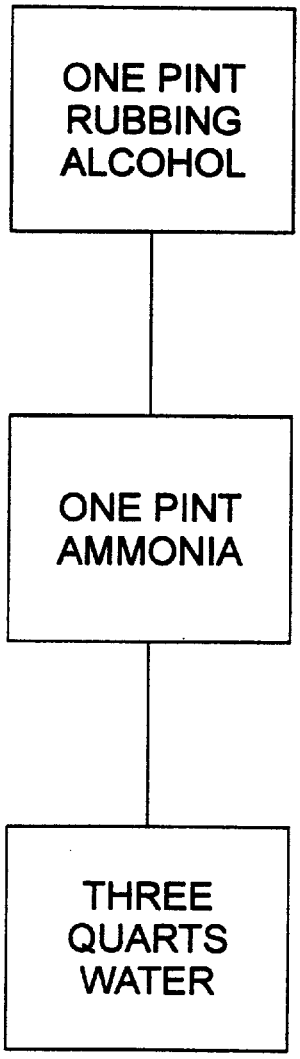
FIG. 2 sets forth a flow chart of an alternative embodiment setting forth volume of elements to be combined in solution.
Figure 3:
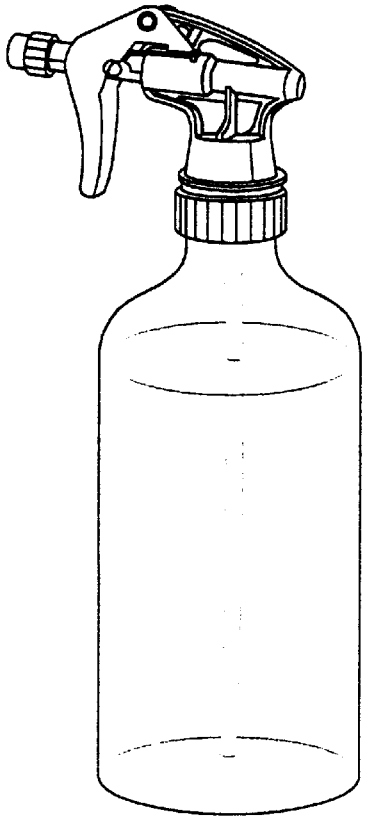
FIG. 3 illustrates a perspective view of a spray bottle with which the inventive solution may be applied.
Figure 4:
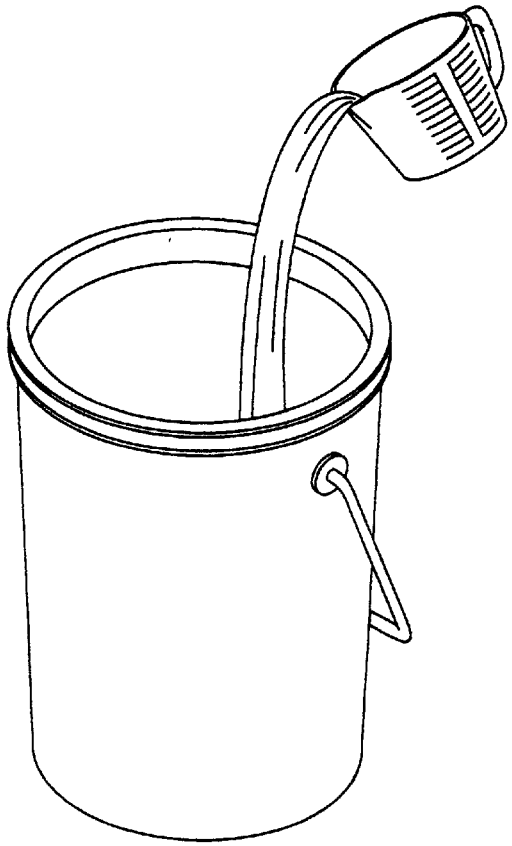
FIG. 4 illustrates a bucket and cup used for mixing a solution.

An all purpose household cleanser is disclosed herein. In the preferred embodiment, the solution for the cleanser is comprised of one pint rubbing alcohol, one pint ammonia, three quarts of tap water and two tablespoons of dishwashing detergent. Preferably a lemon scented dishwashing detergent, which is readily obtainable, is used. The ingredients are mixed in a container which holds at least one gallon. The cleanser can be used for virtually any household surface such as floors, windows, carpets, upholstery etc. This cleanser may be used to clean toilets, however it does not successfully remove rust marks.

To apply the solution to a surface to be cleaned, pour the cleanser solution full strength into a spray bottle, and spray on the article to be cleaned. Alternatively, dilute one cup of the cleanser with one gallon of water, when the cleaning job requires a lesser strength cleansing solution.

The all purpose household cleanser is a safe and all-purpose cleanser designed to replace virtually all other cleansers used to clean the home. The cleanser as aforementioned may be used full strength or diluted in a gallon of water. The cleanser quickly and easily cleans most surfaces to be found in a home or business office.

The inventor has made comparison tests between the disclosed invention and other commercial cleansers, resulting in a more favorable result with the all purpose household cleanser disclosed. The all purpose cleanser as disclosed does an excellent job of removing soil from surfaces such as walls, windows and floors. The invention may be used from a spray bottle or poured into a bucket and used with a brush or rag. The all purpose household cleanser is designed to be used in place of a variety of household cleaning products now required for cleaning all the various surfaces in a house. It also has performed more efficiently than other cleaners available on the market.

According to the provisions of patent statutes, I have explained the principle preferred construction and mode of operation of my invention and have illustrated and described what I now consider to represent its best embodiments. However, it should be understood that within the scope of the appended claims, the invention may be practiced otherwise and as specifically illustrated and described.

I claim:

1. An improved household cleaning solution consisting of one pint liquid rubbing alcohol, one pint liquid ammonia, three quarts of water, plus two tablespoons of liquid dishwashing detergent.

2. The improved household cleaning solution as set forth in claim 1, wherein said liquid dishwashing detergent is lemon scented.

3. An improved household cleansing solution comprising by volume ⅛ part liquid rubbing alcohol; ⅛ part liquid ammonia; ¾ part tap water; to which is added two tablespoons of liquid dishwashing detergent.

4. The improved household cleansing solution as set forth in claim 3, wherein said liquid dishwashing detergent is lemon scented.

* * * * *